United States Patent [19]

Scuderi

[11] Patent Number: 4,766,733

[45] Date of Patent: Aug. 30, 1988

[54] REFRIGERANT RECLAMATION AND CHARGING UNIT

[76] Inventor: Carmelo J. Scuderi, 173 Prospect St., Springfield, Mass. 01107

[21] Appl. No.: 110,122

[22] Filed: Oct. 19, 1987

[51] Int. Cl.[4] ..... F25B 45/00

[52] U.S. Cl. ..... 62/77; 62/149; 62/292

[58] Field of Search ..... 62/85, 149, 292, 475, 62/503, 513, 174, 77

[56] References Cited

U.S. PATENT DOCUMENTS

| | | | |
|---|---|---|---|
| 3,232,070 | 2/1966 | Sparano | 62/149 |
| 4,261,178 | 4/1981 | Cain | 62/149 |
| 4,363,222 | 12/1982 | Cain | 62/292 |
| 4,364,236 | 12/1982 | Lower et al. | 62/77 |
| 4,441,330 | 4/1984 | Lower | 62/149 |
| 4,539,817 | 9/1985 | Staggs | 62/149 |
| 4,554,792 | 11/1985 | Margulefsky et al. | 62/77 |
| 4,646,527 | 3/1987 | Taylor | 62/85 |

*Primary Examiner*—Henry A. Bennet

*Attorney, Agent, or Firm*—Fishman, Dionne & Cantor

[57] ABSTRACT

A self-contained refrigerant reclamation and charging unit is connected between the refrigeration system to be charged or evacuated and a standard refrigerant receiver. Rather than using a pump (vacuum or otherwise) or an auxiliary refrigerant system (as in many prior art devices), the present invention utilizes a portion of the refrigerant being evacuated to continuously cool itself as the refrigerant travels between the refrigeration system to be evacuated and a storage receiver. As the refrigerant is cooled, the pressure thereof drops creating a pressure differential from the refrigeration system into the receiver.

14 Claims, 3 Drawing Sheets

REFRIGERANT RECLAMATION AND CHARGING UNIT

BACKGROUND OF THE INVENTION

This invention relates to an apparatus for servicing cooling systems of the type utilizing a compressible refrigerant as the cooling medium. More particularly, this invention relates to an apparatus for the reclamation and charging of refrigerants from and to a cooling system wherein the refrigerant is precluded from escape to the atmosphere.

It is well known that the dumping of presently used refrigerants which consist of chlorofluorocarbons (CFC) is extremely damaging to the environment due to their deleterious effect on the ozone layer. Moreover, there is now worldwide agreement on regulating production and use of CFC's. As a result, the cost of CFC's, which is already high, will rise dramatically.

Presently, there is no easy, practical method for evacuating a charged refrigeration system of its refrigerant (CFC) and storing it in a receiver. This is primarily because of the nature of the refrigerant. Most refrigerants, (such as FREON) exist as a gas at room temperature and atmospheric pressure. Within a pressurized refrigeration system at room temperature, the freon exists as both a liquid and a gas. If a direct connection were made from the refrigeration system to a receiver, the freon gas would expand and the freon liquid would boil until enough gas would enter the receiver to equalize the pressure in the receiver and the refrigeration system. The net result would be that only a small amount of freon would be transferred into the receiver.

If a pump were used to pump the freon from the refrigeration system to a receiver it would have to be designed to pump both liquid and gaseous freon at the same time. This would make the pump both expensive and bulky. A vacuum pump cannot be used to transfer the freon since the freon would build up pressure as it enters the receiver, and a vacuum pump cannot discharge into a pressurized system.

Finally, heating the freon in the refrigeration system until it all boils off and transfers to the receiver is possible but not very practical. This is because the bulk, shape, and installation of most refrigeration systems does not easily lend itself to being heated. Also, overheating the system could cause excessively high pressure and could therefore be dangerous.

Prior art devices have been suggested for the recovery and charging of refrigerants. U.S. Pat. No. 4,539,817 uses a standard refrigeration system which cools the recovered freon indirectly by utilizing an evaporator coil in a sealed tank. The coolant in the evaporator coils (auxiliary refrigerant) is cooled by the unit's standard refrigeration system. This creates a temperature difference between the auxiliary freon in the coils and the freon in the tank (e.g. the freon to be recovered). As a result, the freon in the tank is cooled, creating a pressure differential, and allowing freon to flow into the recovery tank.

U.S. Pat. No. 4,646,527 describes a refrigerant recovery system which utilizes a pair of accumulators connected in line between a compressor and the refrigeration system to be evacuated. U.S. Pat. No. 4,476,688 discloses a self-contained refrigerant recovery system which involves diverting a portion of liquified gas to an evaporator coil which is in heat exchange relationship with a condenser coil. U.S. Pat. No. 3,232,070 utilizes a compressor or pump to remove refrigerant and deliver it to a receiver. Finally, U.S. Pat. Nos. 4,554,792; 4,480,446; 4,441,330; 4,364,236; 4,363,222; and 4,261,178 all relate to use of a pump (e.g. vacuum pump) to evacuate refrigerant from a refrigeration system.

Despite the large number of proposed refrigerant recovery and charging devices, there continues to be a need for an apparatus which is simple in design and therefore less expensive to manufacture. There is also a need for a refrigerant recovery device which has the ability to fully evacuate the refrigerant from a given system; and if possible, to utilize existing standard refrigeration receivers for recovering the refrigerant.

SUMMARY OF THE INVENTION

The above discussed and other problems and deficiencies of the prior art are overcome or alleviated by the refrigerant recovery and charging device of the present invention. In accordance with the present invention, a self-contained refrigerant reclamation and charging unit is connected between the refrigeration system to be charged or evacuated and a standard refrigerant receiver. Rather than using a pump (vacuum or otherwise) or an auxiliary refrigerant system (as in U.S. Pat. No. 4,539,817), the present invention utilizes a portion of the refrigerant being evacuated to continuously cool itself as the refrigerant travels between the refrigeration system to be evacuated and a storage receiver. As the refrigerant is cooled, the pressure thereof drops creating a pressure differential from the refrigeration system into the receiver.

Thus, the present invention utilizes the principal that as freon is cooled, its pressure drops. The present invention actually cools the freon as it enters the receiver to keep the receiver pressure lower than the pressure of the refrigeration system to be evacuated. Therefore, the freon gas and liquid will be forced to flow in the direction of the pressure differential from the refrigeration system into the receiver. This is accomplished by making the receiver act as an evaporator in a novel refrigeration cycle.

The refrigerant recovery and charging unit of ths present invention provides many features and advantages over prior art units of this type. For example, the present invention has a relatively simple design and is therefore inexpensiva to manufacture; the unit will fully recover refrigerant from a given system; and the unit utilizes existing standard refrigerant receivers for further cost savings.

The above discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
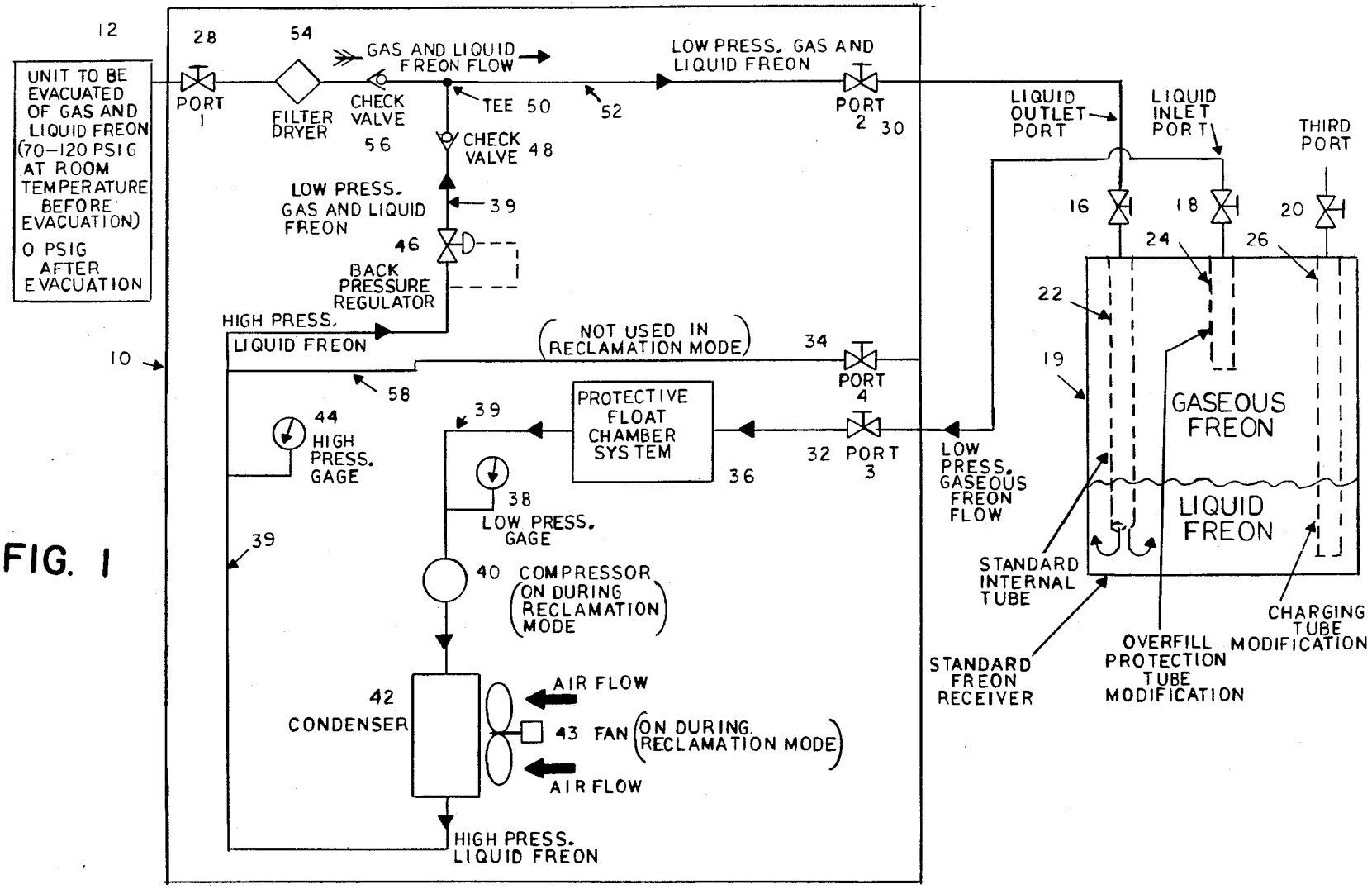
FIG. 1 is a schematic drawing of a refrigerant recovery and charging unit of the present invention shown in a recovery mode.

Turning first to FIG. 1, a refrigerant reclamation and charging unit in accordance with the present invention is shown generally at 10. As will be discussed hereinafter, during operation, unit 10 is in fluid communication with a refrigeration system to be evacuated shown schematically at 12 and a standard refrigerant receiver 14. Receiver 14 includes a valve or port 16 (which is generally labeled the "liquid outlet" port on most standard receivers), a liquid inlet valve or port 18 and a third valve or port 20. Port 16 communicates with a standard internal tube 22 which extends down to near the bottom of receiver 14. Valve 18 communicates with a shorter internal tube 24 while third valve 20 communicates with a charging tube 26 which also terminates near the bottom of receiver 14.

The refrigerant reclamation and charging unit 10 includes four ports or valves 28, 30, 32 and 34. During the reclamation mode, port 28 is connected to the system to be evacuated 12. Port 30 is connected to the receiver outlet port 16. Port 32 is connected to the liquid inlet port 18 of receiver 14. Port 34 is not used in the reclamation mode, but will be discussed hereinafter with reference to the charging mode shown in FIG. 2.

Internally, the reclamation and charging unit 10 comprises (in a first line 39 extending in the direction of the arrows from port 32), a protective float chamber system 36, a low pressure gage 38, a compressor 40, a condenser 42/fan 43 assembly, a high pressure gage 44, a back pressure regulator 46 and a check valve 48. At this point, line 39 terminates at a tee 50. Communicating with tee 50 is a second line 52 which includes a filter dryer 54 and check valve 56 between port 28 and the left side of tee 50. Line 52 terminates at the right side of tee 50 at port 30. A third line 58 (which is not used in the reclamation mode, but will be discussed with reference to FIG. 2) communicates between line 39 (upstream from high pressure gage 44) and port 34.

When ports 28, 30 and 32 are turned on, the pressure in receiver 14 will quickly charge with a small amount of freon gas, until it is equal to the pressure in the system to be evacuated 12. In this reclamation mode, compressor 40 and condenser fan 43 are turned on. As a result, freon gas is drawn out of the top of receiver 14 into port 32. This has the effect of lowering the pressure in receiver 14, boiling off a small amount of freon that would accumulate at the bottom of receiver 14, and cooling the freon that enters receiver 14 from the system to be evacuated 12. This cooling effect helps to lower the pressure in the receiver even further. After the freon enters port 32, it is compressed by the compressor 40 and thereafter enters condenser 42.

Because of the back pressure regulator 46, the pressure of the freon will remain high as it enters the condenser 42 where it will condense to a liquid as it exchanges its heat energy with the ambient air because of the air flow produced by fan 43. This high pressure liquid freon will drop drastically in pressure across the back pressure regulator 46, further cooling itself and the freon from the system to be evacuated 12 as it mixes therewith at the tee 50. Thus, at tee 50, the low temperature freon from line 39 will mix with the higher temperature freon from system 12 flowing through line 52 and reenter receiver 14 completing the cycle.

This constant cooling of the freon in receiver 14 will have the net effect of keeping the receiver pressure below that of the system to be evacuated 12 until essentially all the freon in the system to be evacuated has migrated to receiver 14. When this is done the pressure in the unit to be evacuated 12 and in the receiver 14 will be about 0 PSIG, most of the freon will be in receiver 14 in liquid form, and the freon will have been cooled to about −20 to −40 degrees F.

Figure 2:
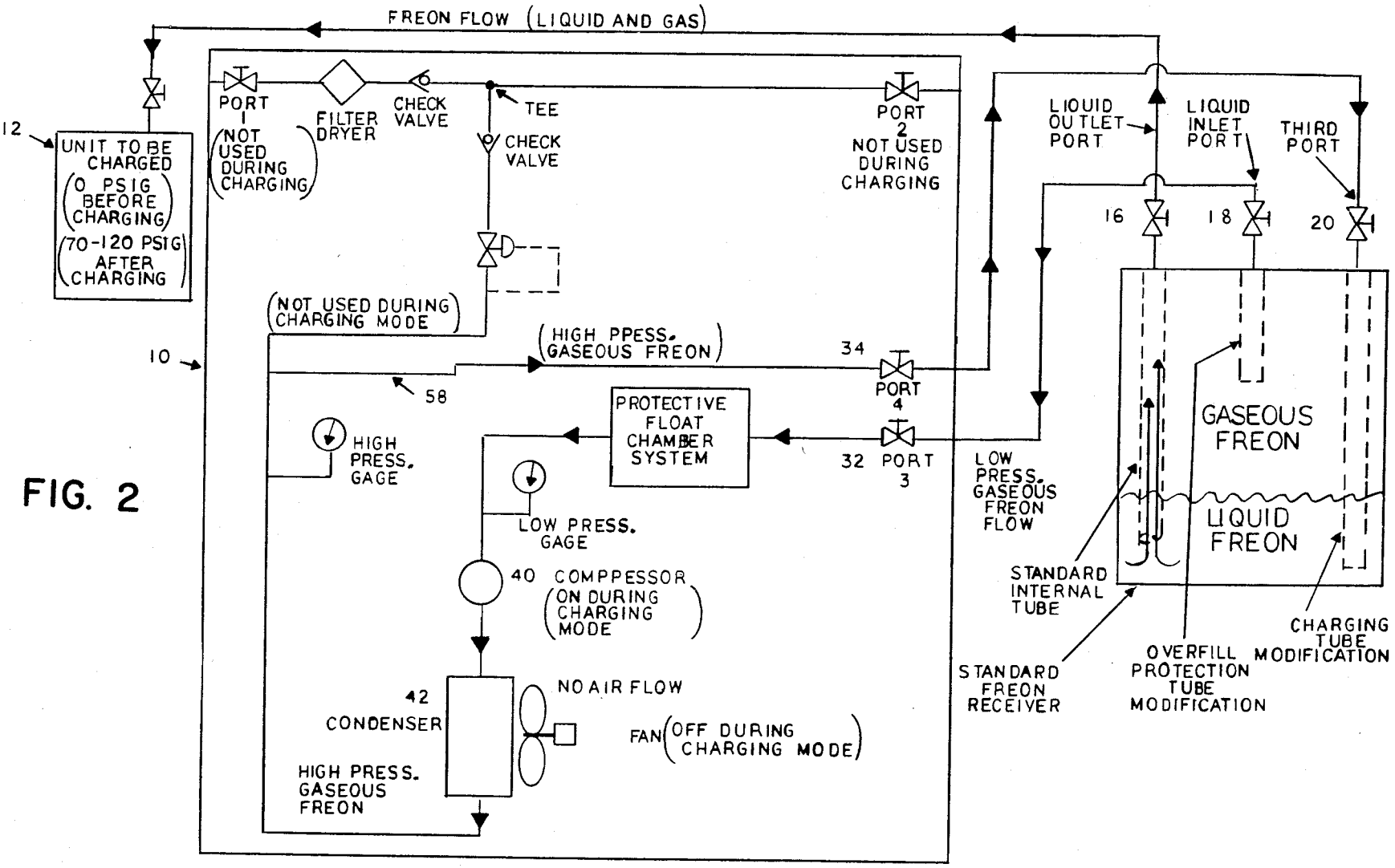
FIG. 2 is a schematic drawing of the recovery and charging unit of FIG. 1 shown in a charging mode.

When the system has been evacuated and serviced, it can then be recharged with the same freon using the charging mode of the present invention as shown in FIG. 2. Turning to FIG. 2, in the charging mode, port 32 is connected to the liquid inlet port 18 of receiver 14. The liquid outlet port 16 of receiver 14 is connected directly to the system to be charged 12 and port 34 of unit 10 is connected to the remaining third port 20 on receiver 14. In the charging mode, only compressor 40 is turned on, the condenser fan 43 is not turned on. Back pressure regulator 46 will also be shut (because ports 28 and 30 will be closed) to provide a circuit from line 39 directly to line 58.

In this charging configuration, freon gas is circulated through port 32 into compressor 40 where it picks up heat as it is compressed. The freon does not lose this heat energy in condenser 42 since fan 43 is not turned on and produces no air flow. The heated and compressed freon gas will then flow into line 58 through port 34 to port 20 and down the charging tube 26 of receiver 14 into the liquid freon. The heated freon gas therefore warms the cooler liquid freon at the bottom of the receiver. This has the effect of raising the pressure in the receiver, forcing liquid and gaseous freon out the liquid outlet port 16 and into the system to be charged 12. This cycle continues until virtually all of the freon in container 14 has been transferred to system 12 by the pressure differential between receiver 14 and system 12 which has been created by the heating of the freon in receiver 14.

It will be appreciated that a standard freon receiver would usually not include the charging tube 26 and so such a tube would have to be added when the present invention is used in the charging mode. It will be further appreciated that such a modification is minor and would not entail any appreciable costs or time.

Figure 3:
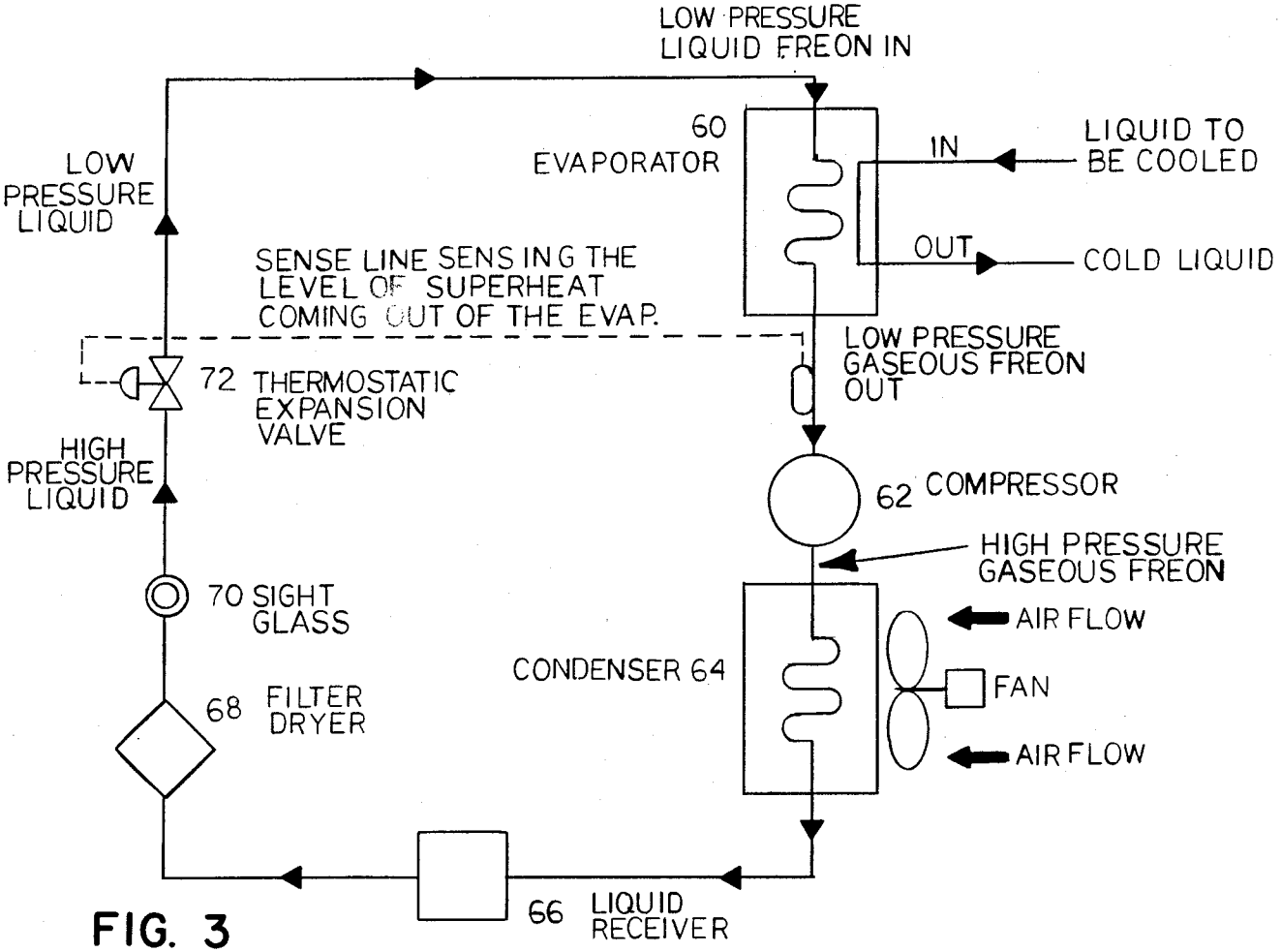
FIG. 3 is a schematic drawing of a standard refrigeration circuit.

In order to more fully understand the present invention, a standard refrigeration cycle will now be described. Turning to FIG. 3, such a standard cycle is shown. In a standard refrigeration cycle, a process liquid is cooled by an evaporator heat exchanger 60 as the refrigerant, typically freon, boils at low pressure and low temperature on one side of the evaporator. Heat is exchanged from the liquid to be cooled to the evaporating freon and the cooled liquid (or process) is kept separate from the freon side of the heat exchanger. Freon gas is then compressed to a high pressure by a compressor 62.

The heat picked up by the freon in evaporator 60 and from compressor 62 is released to the atmosphere in a condenser heat exchanger 64 as the freon is condensed at a high pressure and high temperature.

High pressure liquid freon then flows through a liquid receiver 66, filter dryer 68 and sight glass 70, up to an expansion valve 72. Expansion valve 72 is designed to drop the pressure of the freon across it as it regulates the amount of superheat coming out of evaporator 60. In other words, expansion valve 72 senses the superheat (the temperature of the freon above its boiling point) at the outlet of evaporator 60. As the superheat changes, the orifice in expansion valve 72 is adjusted to meter more or less freon across it to keep the superheat constant. This will also drop the freon pressure so that it can again evaporate at a low temperature.

Turning now to a joint discussion of FIGS. 1 and 3, in the unit of the present invention, a freon receiver 14 is used in place of the normal evaporator heat exchanger in a standard refrigeration system (see item 60 in FIG. 3) and a back pressure regulator 48 is used in place of the expansion valve (see item 22 in FIG. 3).

Unlike the normal evaporator heat exchanger, the primary purpose of the evaporating freon in standard receiver 14 is not to absorb heat from another process or liquid, but to cool itself so that the freon pressure in receiver 14 always remains lower than the pressure in the system to be evacuated 12. In this way there will always be a pressure differential from the system to be evacuated 12 to the receiver 14 so liquid freon and gas will flow into receiver 14 from the system to be evacuated 12.

Unlike the normal expansion valve, the primary purpose of back pressure regulator 46 is not to sense the superheat leaving the evaporator, but to regulate the pressure at the outlet of compressor 40 and condenser 42 at some constant high level, regardless of what happens to the pressure down stream of regulator 46. In this way, even though the pressure in receiver 14 will ultimately drop to about 0 PSIG, the pressure in condenser 42 will remain high enough to condense freon in ambient conditions of about 90 degrees F.

The refrigerant recovery and charging unit of the present invention provides many features and advantages over prior art devices. For example, because incoming refrigerant is cooled directly by a portion of the refrigerant itself (rather than using an auxillary refrigerant system), the incoming refrigerant temperature (and therefore pressure) can be dropped lower and more refrigerant can be recovered from an outside system. Additionally, since the present invention does not require coils manufactured in a sealed tank (as, for example, U.S. Pat. No. 4,539,817), the present invention will be less expensive to manufacture. This economy of design is expanded by use of a standard freon receiving tank to reclaim the refrigerant (with the simple addition of a charging tube in the third port of the standard receiving tank). Finally, maintenance of the present invention is low since there is no auxiliary refrigerant system which can need repair.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for recovering compressible refrigerant from a refrigeration system and delivering the recovered refrigerant to refrigerant receiver means comprising:

first fluid carrying line means, a first end of said first line means adapted for fluid communication with a refrigeration system and a second end of said first line means adapted for fluid communication with a refrigerant receiver means;

second fluid carrying line means, a first end of said second line means being in fluid communication with said first line means and a second end of said second line means adapted for fluid communication with the refrigerant receiver means, said second fluid carrying line means including;

compressor means in communication with said second end of said second line means;

condenser means downstream of said compressor means; and back pressure regulator means downstream of said condenser means wherein refrigerant is adapted to flow from the refrigerant receiver means sequentially through said compressor means, condenser means, back pressure means and into said first line means wherein the refrigerant mixes with refrigerant from the refrigeration system which is flowing into the refrigerant receiver means.

2. The apparatus of claim 1 wherein the refrigerant receiver means is in fluid communication with said first and second line means and wherein said receiver means comprises:

housing means for storing refrigerant, said housing means having a top and bottom;

a first port in said housing means associated with an internal tube in said housing means, said internal tube terminating near said bottom of said housing means, said first port being in fluid communication with said second end of said first line means; and a second port in said housing means, said second port being in fluid communication with said second end of said second line means.

3. The apparatus of claim 1 wherein:

said first line means communicates with said second line means at a tee.

4. The apparatus of claim 1 wherein:

said first line means terminates at said first end at a first port and at said second end at a second port; and said second line terminates at said first end at a tee and at second end at a third port.

5. An apparatus for charging compressible refrigerant to a refrigeration system from refrigerant receiver means, the refrigerant receiver means being in fluid communication with the refrigeration system comprising:

first fluid carrying line means, a first end of said first line means being adapted for fluid communication with a first port on a refrigerant receiver means and a second end of said first line means being adapted for fluid communication with a second port on a refrigerant receiver means, said first fluid carrying line means including;

compressor means in communication with said first end of said first line means; and wherein refrigerant stored in the receiver means is adapted to flow from the first port of the receiver means through said first fluid line means to said compressor means, and back into the second port of the receiver means to thereby heat the refrigerant remaining in the receiver means forcing a portion of the heated refrigerant from the receiver means into the refrigeration system.

6. The apparatus of claim 5 wherein the refrigerant receiver means is in fluid communication with said first line means and wherein said receiver means comprises:

housing means for storing refrigerant, said housing means having a top and bottom;

said second port being located on said housing means and being associated with a first internal tube in said housing means, said first internal tube terminating near said bottom of said housing means; and a third port being located on said housing means and being associated with a second internal tube in said housing means, said second internal tube terminating near said bottom of said housing means, said third port adapted to be in fluid communication with the refrigeration system.

7. The apparatus of claim 5 wherein:

said first line means terminates at said first end at a first port and at said second end at a second port.

8. A method for recovering compressible refrigerant from a refrigeration system and delivering the recovered refrigerant to refrigerant receiver means comprising the steps of:

delivering refrigerant from a refrigeration system to refrigerant receiver means through a first fluid carrying line;

delivering refrigerant from the refrigerant receiver means to said first fluid line through a second fluid carrying line wherein the refrigerant from said second fluid line mixes with the refrigerant from said first fluid line and wherein prior to mixing in said first fluid line, the refrigerant in said second fluid line undergoes the sequential process steps of;

compressing gaseous refrigerant from the receiver means to form high pressure gaseous refrigerant;

condensing the compressed high pressure gaseous refrigerant to form high pressure liquid refrigerant;

maintaining the pressure of said compressed refrigerant high; and dropping the pressure of the high pressure liquid refrigerant to cool the liquid refrigerant wherein the cooled liquid refrigerant is mixed with the refrigerant in the first line coming from the refrigeration system.

9. The method of claim 8 wherein:

the pressure of the refrigerant in the second line is maintained high by back pressure regulator means.

10. The method of claim 8 wherein:

heat is removed from the condensed high pressure refrigerant in the second line by fan means.

11. A method for charging compressible refrigerant to a refrigeration system from refrigerant receiving means, the refrigerant receiving means being in fluid communication with the refrigeration system, comprising the steps of:

withdrawing gaseous refrigerant from the refrigerant receiving means;

compressing said gaseous refrigerant to form high pressure gaseous refrigerant;

delivering said high pressure gaseous refrigerant back to the receiver means; and mixing said high pressure gaseous refrigerant with liquid refrigerant present in the receiving means wherein said liquid refrigerant is heated creating a pressure differential between the receiving means and the refrigeration system, the pressure differential causing the refrigerant to flow from the receiving means to the refrigeration system.

12. Apparatus for recovering compressible refrigerant from a refrigeration system and delivering the recovered refrigerant to refrigerant receiver means comprising:

means for delivering refrigerant from a refrigeration system to refrigerant receiver means through a first fluid carrying line;

means for delivering refrigerant from the refrigerant receiver means to said first fluid line through a second fluid carrying line wherein the refrigerant from said second fluid line mixes with the refrigerant from said first fluid line and wherein second fluid line includes;

means for compressing gaseous refrigerant from the receiver means to form high pressure gaseous refrigerant;

means for condensing the compressed high pressure gaseous refrigerant to form high pressure liquid refrigerant;

means for maintaining the pressure of said compressed refrigerant high; and means for dropping the pressure of the high pressure liquid refrigerant to cool the liquid refrigerant wherein the cooled liquid refrigerant is mixed with the refrigerant in the first line coming from the refrigeration system.

13. The apparatus of claim 12 wherein:

said means for maintaining the pressure and said means for dropping the pressure both comprise back pressure regulator means.

14. Apparatus for charging compressible refrigerant to a refrigeration system from refrigerant receiving means, the refrigerant receiving means being in fluid communication with the refrigeration system, comprising:

means for withdrawing gaseous refrigerant from the refrigerant receiving means;

means for compressing said gaseous refrigerant to form high pressure gaseous refrigerant;

means for delivering said high pressure gaseous refrigerant back to the receiver means; and means for mixing said high pressure gaseous refrigerant with liquid refrigerant present in the receiving means wherein said liquid refrigerant is heated creating a pressure differential between the receiving means and the refrigeration system, the pressure differential causing the refrigerant to flow from the receiving means to the refrigeration system.

* * * * *